US010773116B2

(12) United States Patent
Vanderbleek

(10) Patent No.: US 10,773,116 B2
(45) Date of Patent: Sep. 15, 2020

(54) TRAP BAR WITH ADJUSTABLE HANDLES

(71) Applicant: Valor Athletics, Inc., Seminole, FL (US)

(72) Inventor: James Vanderbleek, Seminole, FL (US)

(73) Assignee: Valor Athletics, Inc., Seminole, FL (US)

( * ) Notice: Subject to any disclaimer, the term of this patent is extended or adjusted under 35 U.S.C. 154(b) by 1 day.

(21) Appl. No.: 16/251,224

(22) Filed: Jan. 18, 2019

(65) Prior Publication Data

US 2020/0230457 A1 Jul. 23, 2020

(51) Int. Cl.
*A63B 21/072* (2006.01)
*A63B 23/04* (2006.01)
*A63B 21/075* (2006.01)

(52) U.S. Cl.
CPC ..... *A63B 21/0724* (2013.01); *A63B 21/075* (2013.01); *A63B 23/0405* (2013.01); *A63B 2023/0411* (2013.01)

(58) Field of Classification Search
CPC . A63B 21/06; A63B 21/0615; A63B 21/0616; A63B 21/0617; A63B 21/072; A63B 21/0722; A63B 21/0724; A63B 21/0726; A63B 21/0728; A63B 21/078; A63B 21/40; A63B 21/4027; A63B 21/4033; A63B 21/4035; A63B 21/4041; A63B 21/4047; A63B 21/4049; A63B 23/035; A63B 23/03516; A63B 23/03525; A63B 23/0355; A63B 23/04; A63B 23/0405; A63B 2023/0411; A63B 2225/09; B62G 5/06; B25G 3/38; B25G 1/066
USPC ..... 482/38, 42, 49, 50
See application file for complete search history.

(56) References Cited

U.S. PATENT DOCUMENTS

| | | | | |
|---|---|---|---|---|
| 4,018,442 | A | 4/1977 | Galler | |
| D261,788 | S | 11/1981 | Burns | |
| 4,749,188 | A * | 6/1988 | Montgomery ..... | A63B 21/0602 482/106 |
| 6,004,245 | A | 12/1999 | Boos | |
| 6,663,542 | B1 | 12/2003 | Trabbic | |
| 7,056,268 | B2 | 6/2006 | Emick | |
| 7,837,598 | B1 * | 11/2010 | Boozel, Jr. ..... | A63B 21/151 482/38 |

(Continued)

OTHER PUBLICATIONS

Valor Fitness, OB-HEX Hex Trap Bars, Date First Available: Oct. 14, 2015, [retrieved on Mar. 5, 2020]. Retrieved from the Internet <URL: https://www.amazon.com/Valor-Fitness-Multiple-Options-Deadlifts/dp/B016NAGTVE?th=1> (Year: 2015).*

*Primary Examiner* — Loan B Jimenez
*Assistant Examiner* — Zachary T Moore
(74) *Attorney, Agent, or Firm* — Larson & Larson, P.A.; Justin P. Miller; Frank Liebenow

(57) ABSTRACT

The trap bar with adjustable handles includes a pair of handles. The position of each handle is adjustable in an inward and outward direction, thus varying the distance between the handles. Thus, a user may adjust the handle spacing to accommodate the user's size. A trap bar is used to perform deadlifts and shrugs. A trap bar preferably includes a pair of handles, the handles parallel to each other and parallel to the ground. The parallel positions of the handles support a neutral hand grip and an application of weight in-line with the user's body.

13 Claims, 7 Drawing Sheets

(56) References Cited

U.S. PATENT DOCUMENTS

| | | | |
|---|---|---|---|
| 8,047,975 | B1 | 11/2011 | Chen |
| 8,672,815 | B1 | 3/2014 | Springer |
| 8,951,170 | B1 | 2/2015 | Tayo |
| 9,254,408 | B1 | 2/2016 | Otto |
| 9,833,654 | B1 | 12/2017 | Grant |
| 2017/0106226 | A1 | 4/2017 | Mann |

* cited by examiner

TRAP BAR WITH ADJUSTABLE HANDLES

FIELD

This invention relates to the field of exercise devices and more particularly to a weightlifting bar that includes adjustable handles.

BACKGROUND

Weightlifting as a sport, and form of exercise, has been regaining popularity. Men and women of all ages are taking up weight training. Often the interest begins as a form of exercise, but users may then move to participating in competitions.

A competition includes many types of events, including a variety of lifts, each set up in the form of a station.

The required equipment for each station stays at the station, with a competitor approaching the station, performing the exercise, and then moving on to the next station.

The competitors may be male or female, young or old, and large or small. The differences in gender, age, and size create equipment sizing issues. For example, a large man and a small woman have different widths and preferred hand positions, often requiring compromise. Compromise may result in the competitor experiencing a handicap with respect to a larger or smaller participant, or an increased potential for injury.

This problem is highlighted in the area of deadlifts, specifically for the trap bar, or hex bar.

What is needed is a weightlifting bar with adjustable handles to accommodate users who prefer different handle distances.

SUMMARY

The trap bar with adjustable handles includes a pair of handles. The position of each handle is adjustable in an inward and outward direction, thus varying the distance between the handles. Thus, a user may adjust the handle spacing to accommodate her size.

A trap bar is used to perform deadlifts and shrugs. A trap bar preferably includes a pair of handles, the handles parallel to each other and parallel to the ground. The parallel positions of the handles support a neutral hand grip and an application of weight in-line with the user's body.

Users of any size may wish to use a trap bar, but different user sizes create different ideal hand position requirements. Wider users want a hand grip position that is correspondingly wider to avoid contact between the handles and the user's legs. Correspondingly, smaller users prefer a narrow handle position to avoid reaching too far away from the body to grip the handles. With a hand grip that is too far from the body, the arms move from being straight up-down to angled outward, which increases the difficulty of the lift for a given weight.

A hand grip that can be moved toward and away from the user allows for adjustment prior to the lift, thus making the bar adaptable for many users. This adjustment is ideally performed simply and quickly to avoid any delay in adjustment in a competition type-setting.

The handle assembly of the adjustable hex bar is formed from multiple components. A grip is placed at the end of one or more arms. The arm connects to a rotating or pivoting member, which rotatably interfaces with a fixed sleeve, the fixed sleeve attached to the frame of the hex bar.

In order to prevent undesired rotation, a locking mechanism bridges the grip and the fixed sleeve. Thus, when locked, the grip cannot move, and thus maintains position.

The preferred embodiment of the locking mechanism uses a locking member, or rod, that slides within a channel of the arm. The locking member interfaces with a fixed receiver that attaches to the fixed sleeve or to the frame. The locking member moves through a slot, locking into notches formed between two or more tabs.

To operate the locking mechanism, the user lifts the locking member to move the locking member out of the notch and into the slot, allowing the handle to rotate or pivot about the fixed sleeve, and thus move toward and away from the user.

In the preferred embodiment, to lock the handle in position, an elastic member pulls the locking member down and into a notch. Then, to unlock the user squeezes her hand, raising the locking member toward the grip and thereby permitting rotation of the grip.

With one end of the elastic member affixed to the moving locking member, the other end of the elastic member is fixed in place. Thus, it is attached to a protrusion, hooked into a hole, looped around screw or other fastener, or affixed by other means.

The elastic member is any material that is deformable but that seeks to return to its original shape. For example, a coil spring, leaf spring, rubber band, elastic band, or similar.

Note that locking member need not be part of the handle. In alternative embodiments the locking member is located outside the arm of the handle. As an additional alternative, the entire handle may serve as the locking mechanism, whereby moving the handle up and down acts to engage and disengage the locking mechanism.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
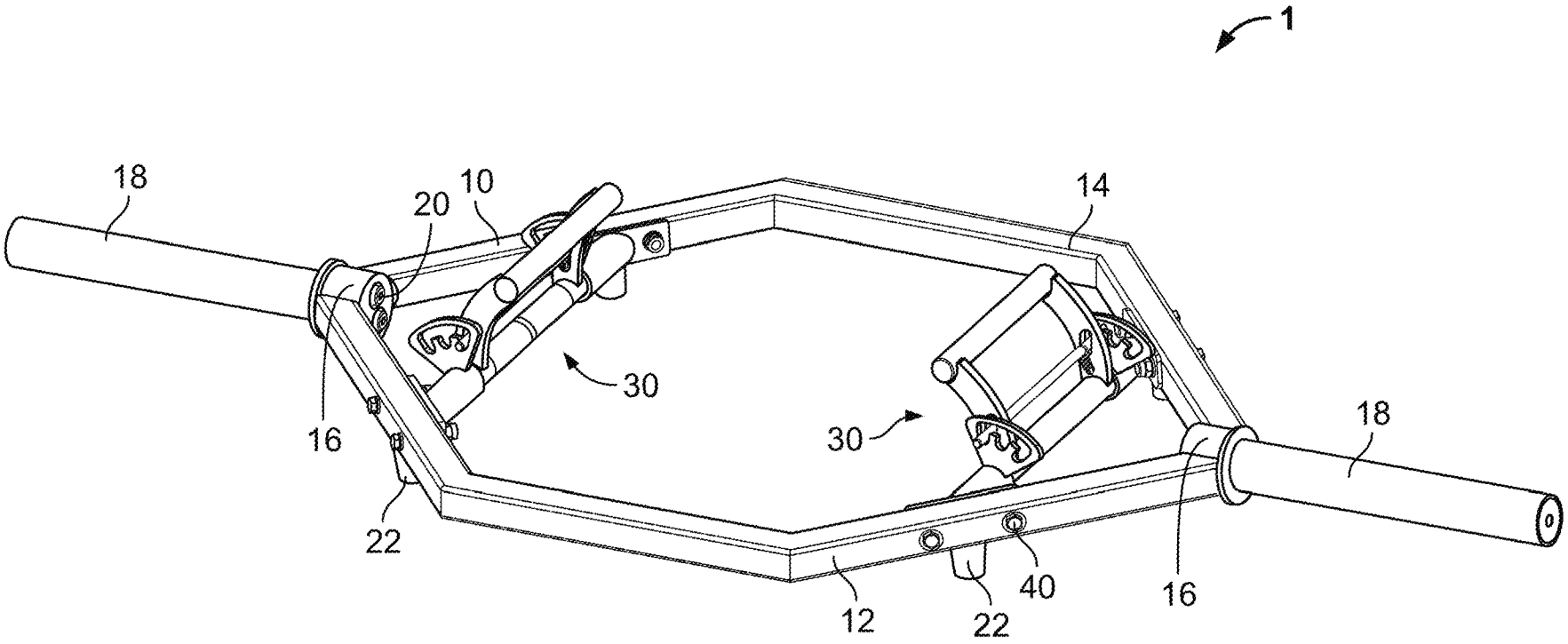
FIG. 1 illustrates an isometric view of the trap bar with adjustable handles.

Reference will now be made in detail to the presently preferred embodiments of the invention, examples of which are illustrated in the accompanying drawings. Throughout the following detailed description, the same reference numerals refer to the same elements in all figures.

Referring to FIG. 1, an isometric view of the trap bar with adjustable handles is shown.

The trap bar with adjustable handles 1 is formed from a frame 10, optionally separated into a front half 12 and a back half 14.

The front half 12 and back half 14 meeting at a pair of collars 16, each collar 16 connecting to a bar 18 using paired fasteners 20. The use of paired fasteners 20 prevents rotation of the bars 18 with respect to the frame 10.

The frame 10 optionally includes feet 22, preferably formed from a rubber-type material.

Figure 2:
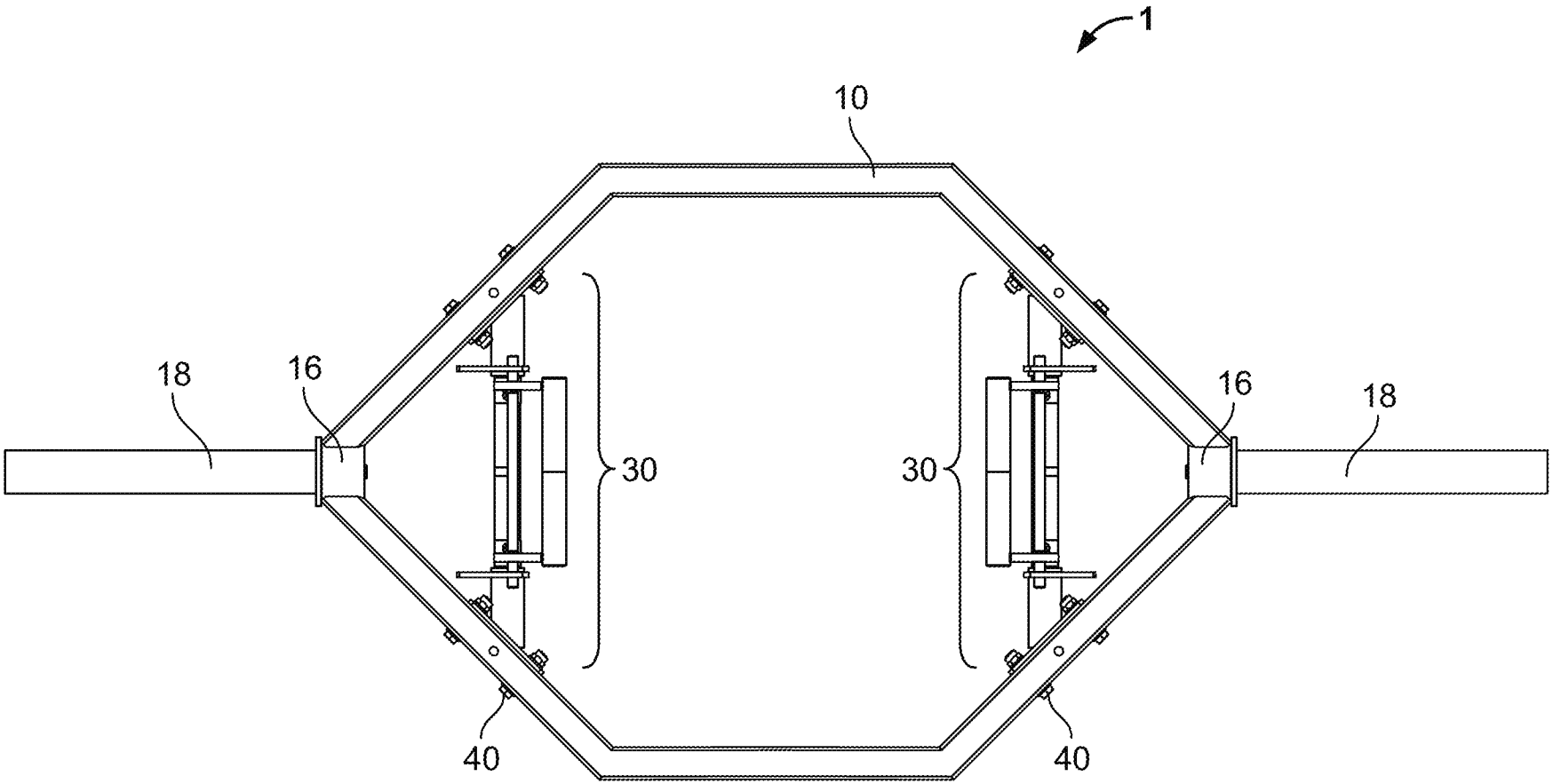
FIG. 2 illustrates a top view of the trap bar with adjustable handles.

Located at the position of a user's hands are two handle assemblies 30, attached to the frame 10 using fasteners 40. Referring to FIG. 2, a top view of the trap bar with adjustable handles is shown.

The trap bar with adjustable handles 1 is again shown with two handle assemblies 30, attached to the frame 10 using fasteners 40. The collars 16 are each shown affixed to a bar 18, which during use is loaded with the user's desired set of weights.

Figure 3:
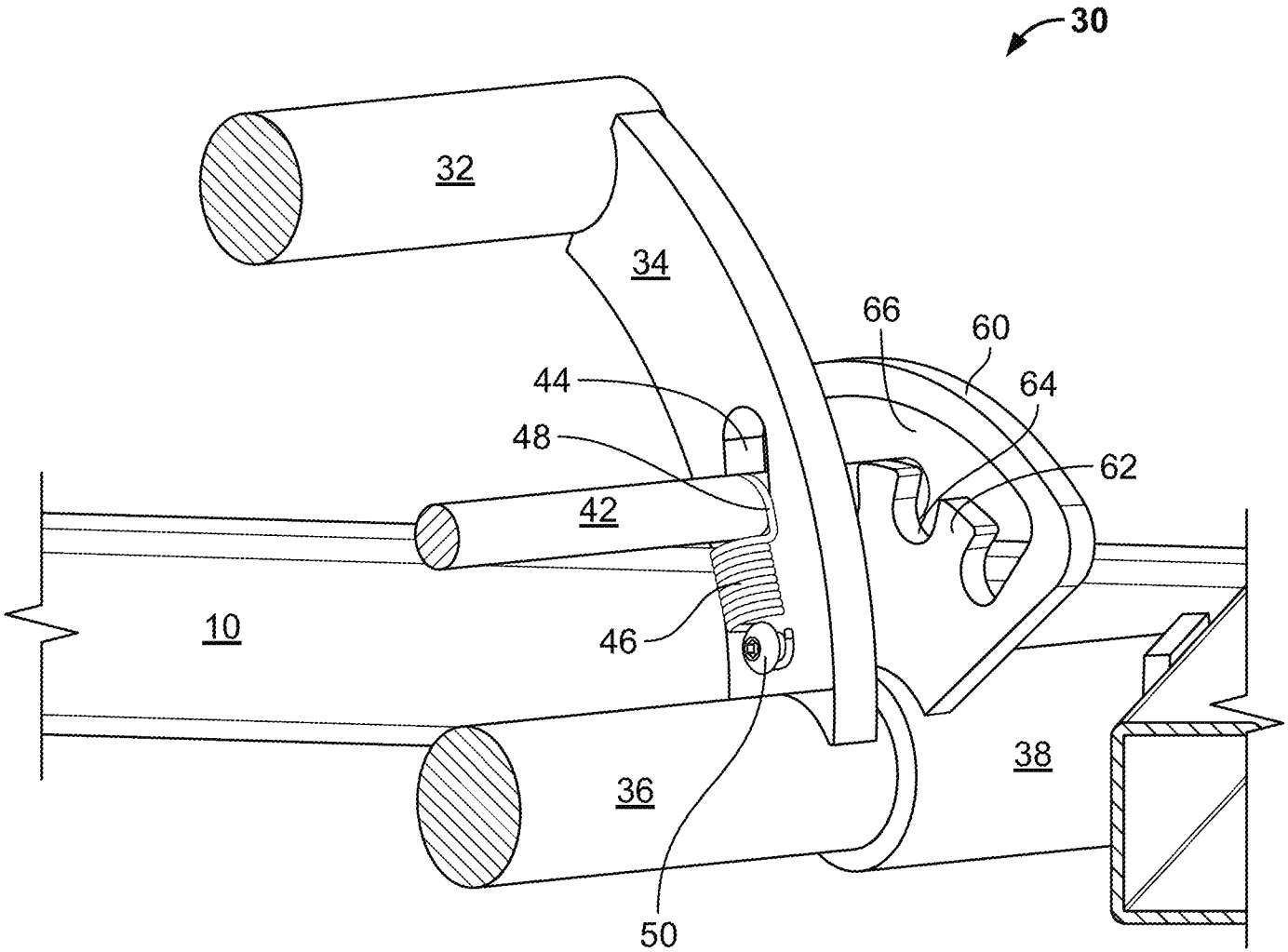
FIG. 3 illustrates a cross-section of the handle assembly of the trap bar with adjustable handles.

Referring to FIG. 3, a cross-section of the handle of the trap bar with adjustable handles is shown.

Each handle assembly 30 is formed from a grip 32, connected to one or more arms 34 that are in turn connected to a rotating member 36. The rotating member 36 preferably rotates inside of a fixed sleeve 38 that is connected to the frame 10.

In order to hold the rotational position of the grip 32 at the user's desired setting, a combination of elements act to fix the angular position of the grip 32 in place.

A locking member 42, shown as a rod, moves within a channel 44 cut out from the arm 34. An elastic member 46 sits within a groove 48 of the locking member 42, pulling the locking member 42 toward a catch 50.

The locking member 42 extends through the channel 44, interfacing with the fixed receiver 60, which is shown mounted to the fixed sleeve 38.

When in a raised position, the locking member 42 moves through a slot 66. When in a lowered position, pulled down by the elastic member 46, the locking member 42 sits within a notch 64 created by one or more tabs 62.

By bridging the arm 34, which may rotate, and the fixed receiver, which may not, locking member 42 holds the grip 32 in a position chosen by the user.

Note that the preferred embodiment includes two arms 34, each with a channel 44, and each with an adjacent fixed receiver 60. The single locking member 42 moves within the channels 44, locking and unlocking within the fixed receivers 60.

Figure 4A:
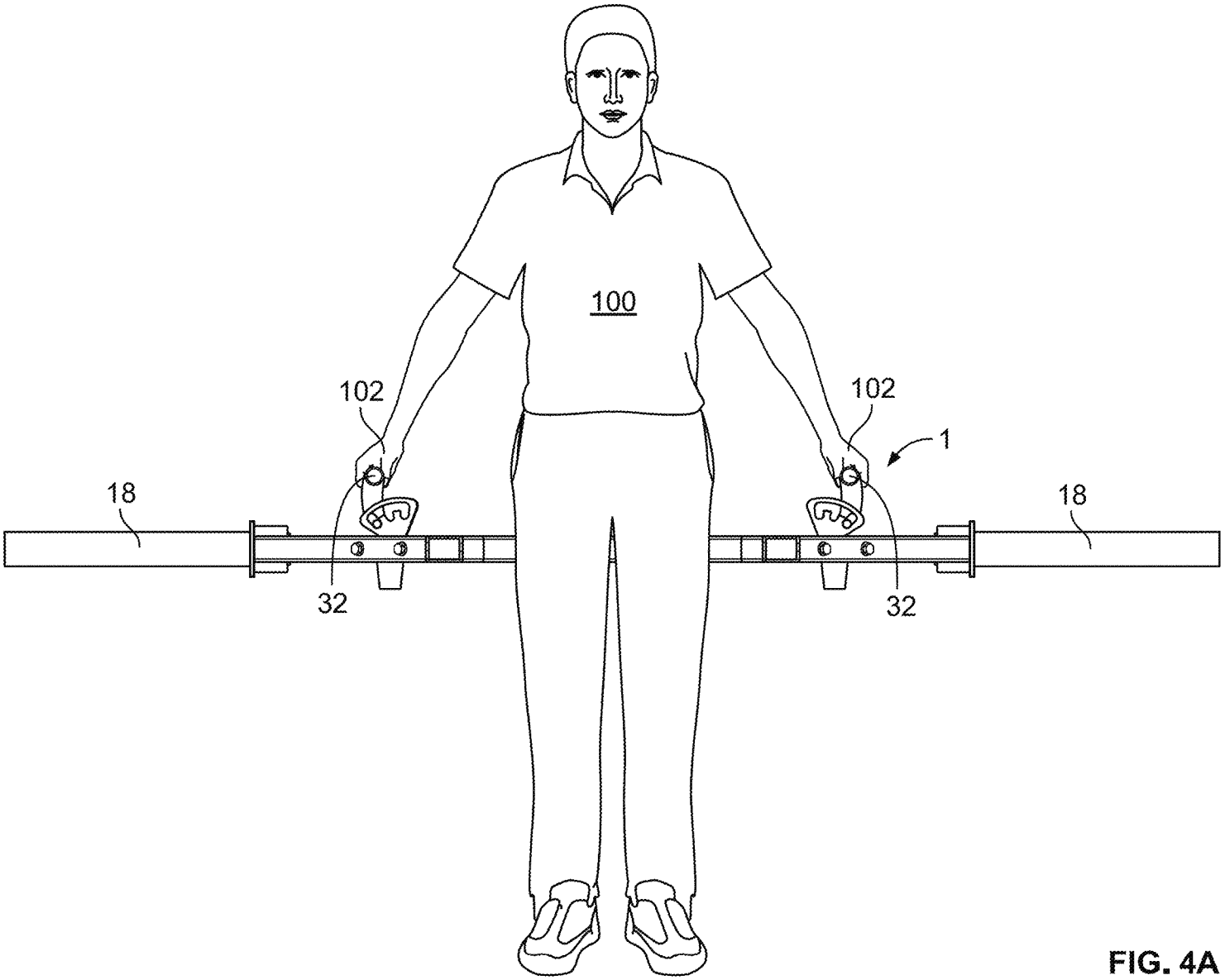
FIGS. 4A and 4B, illustrate a front view showing the trap bar with adjustable handles in use.

Referring to FIGS. 4A and B, a front view showing the of the trap bar with adjustable handles in use is shown.

The trap bar with adjustable handles 1 is shown held by a user 100.

In FIG. 4A, the user 100 has the grips 32 set to the widest position. Note the distance between the user 100 and the grips 32.

Figure 4B:
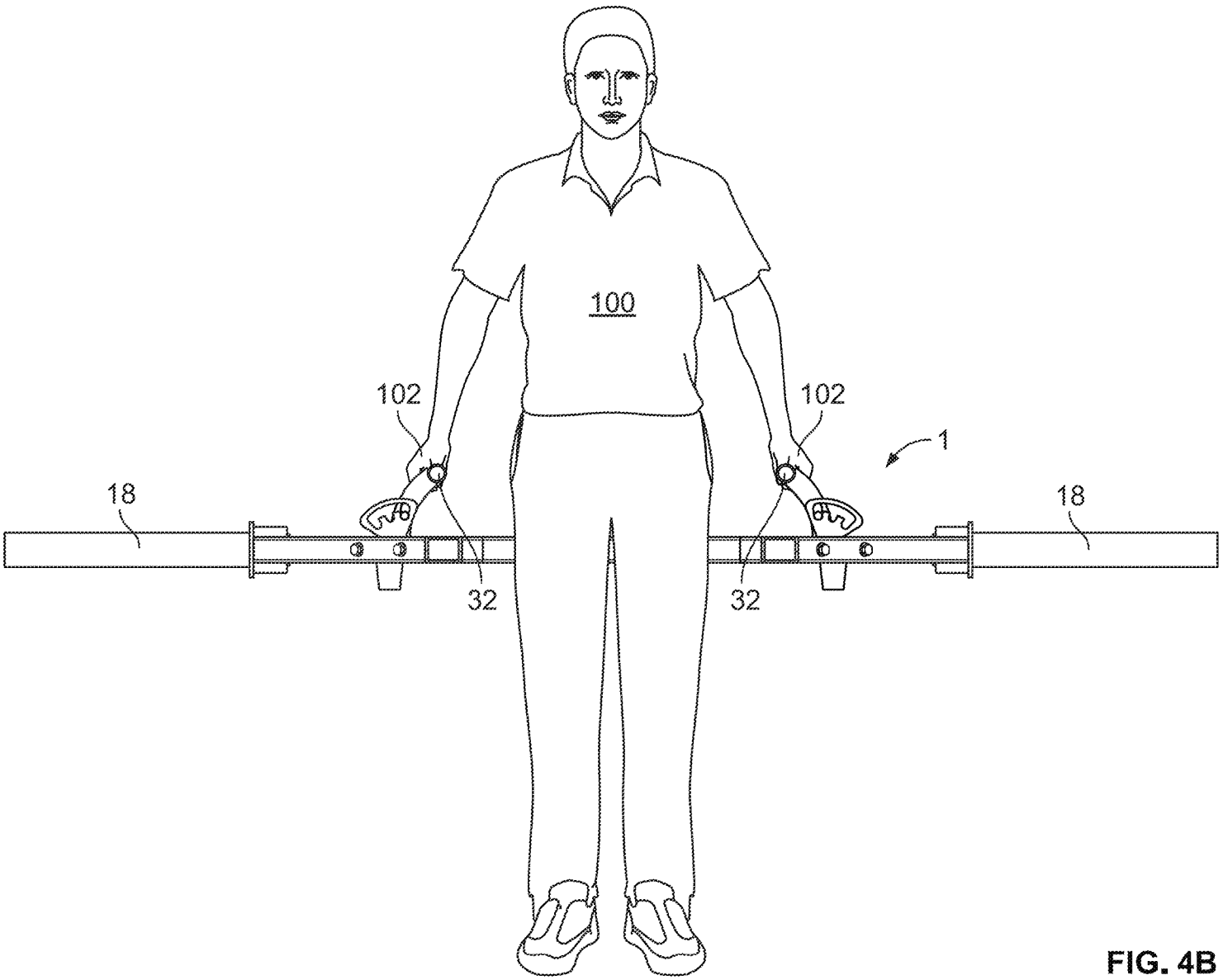

In FIG. 4B, the user 100 has the grips 32 set in an innermost position, but a position that is still wider than the user's hips, and thus a position that does not interfere with the user's body. By moving the grips 32 inward, the user 100 can achieve a more effective lifting position.

Each grip 32 defines an axis, which is in-and-out of the page as shown in FIGS. 4A and 4B. Theses axes remain parallel as the grips 32 are moved toward and away from the use. Additionally, the axes are parallel to the ground, i.e. horizontal, during use.

Figure 5:
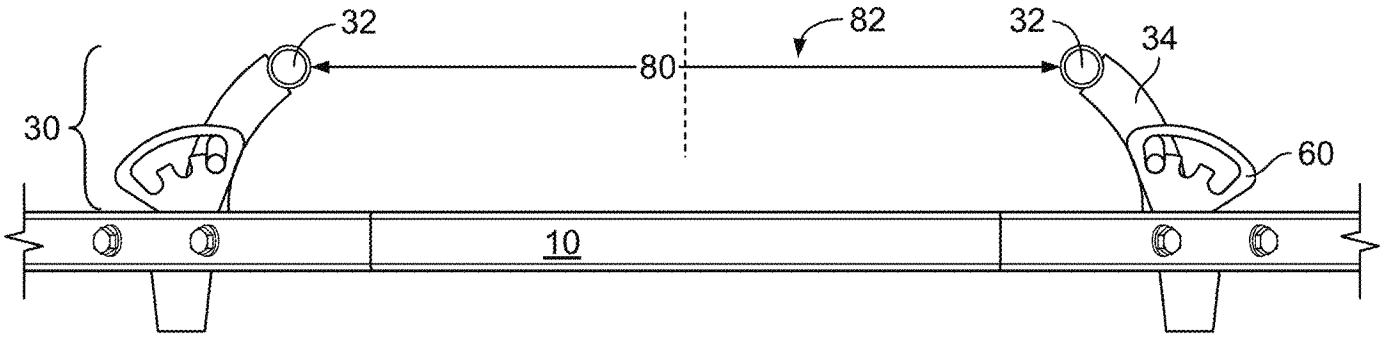
FIG. 5 illustrates a front view with the handles in an inner position.
Figure 6:
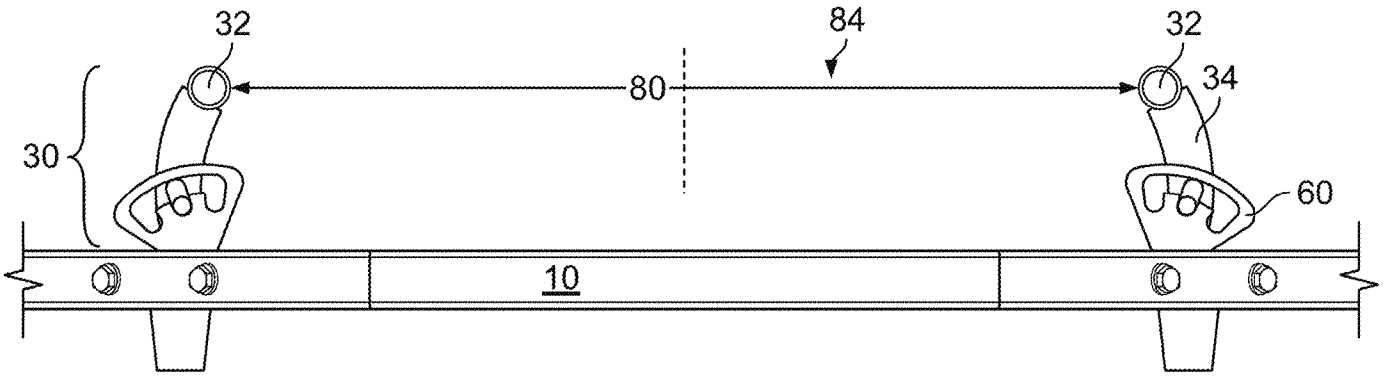
FIG. 6 illustrates a front view with the handles in a middle position.
Figure 7:
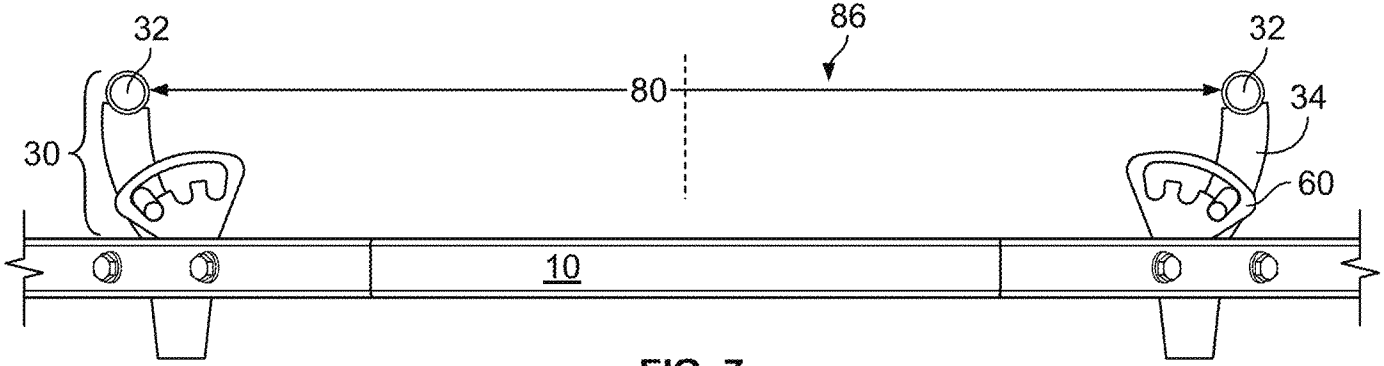
FIG. 7 illustrates a front view with the handles in an outer position.

Referring to FIGS. 5-7, front views with the handles in an inner position, middle position, and outer positions are shown.

By adjusting the position of the grips 32, a user can choose a grip width 80 from a first position 82, second position 84, or third position 86 depending on the user's preferred grip width 80. Note that two grip positions, or four or more grip positions, are anticipated depending on the chosen design of the locking mechanism.

The arms 34 are shown with an optional curved shape. This shape moves the grip 32 further toward the center of the frame 10, thereby expanding the optional range of grip widths 80. Thus, even when the grips 32 are set to a middle position, or second position 84, the user's leg will not contact the fixed receiver 60.

Figure 8:
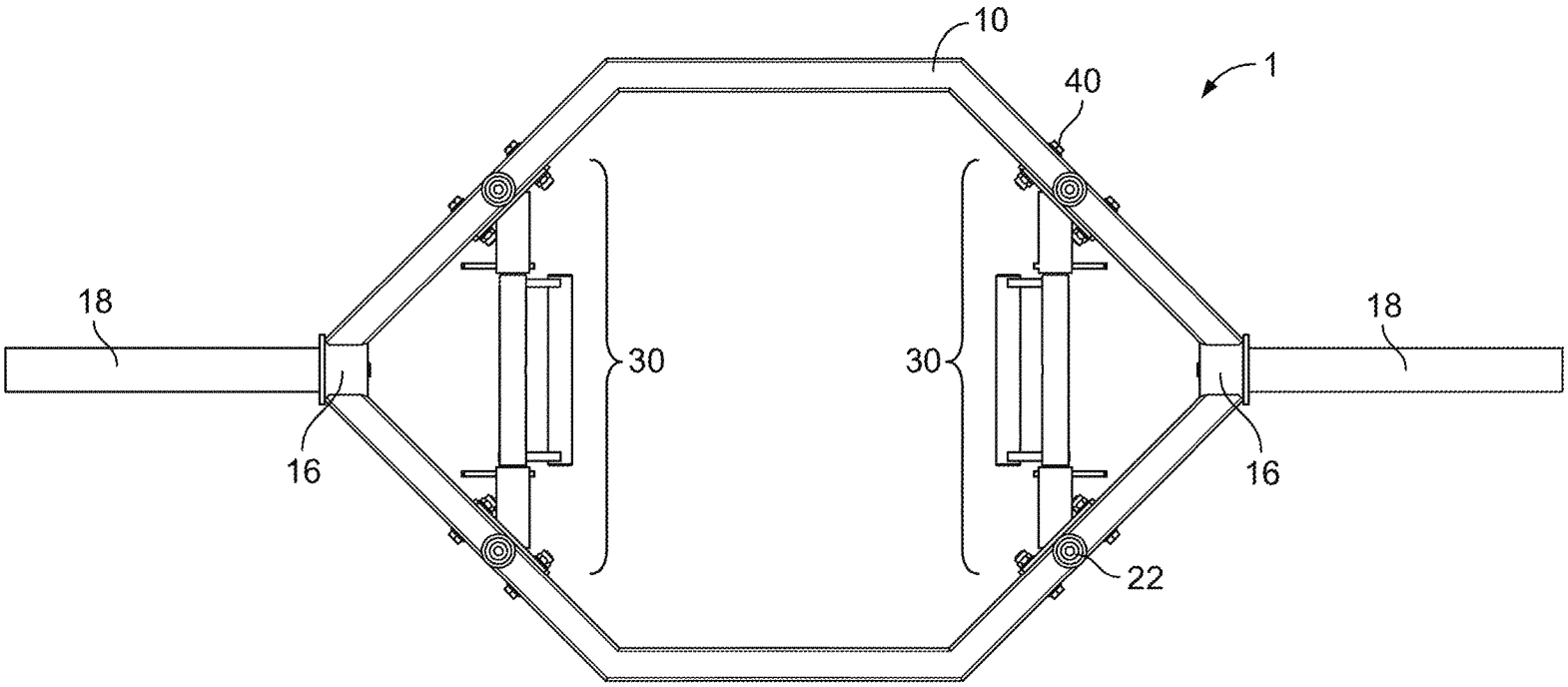
FIG. 8 illustrates a bottom view of the trap bar with adjustable handles.

Referring to FIG. 8, a bottom view of the trap bar with adjustable handles is shown.

The trap bar with adjustable handles 1 is again shown with two handle assemblies 30, attached to the frame 10 using fasteners 40. The collars 16 are each shown affixed to a bar 18, which during use is loaded with the user's desired set of weights.

Multiple feet 22 separate the frame 10 from an underlying surface, and are preferably formed from a high-friction material to prevent sliding.

Figure 9:
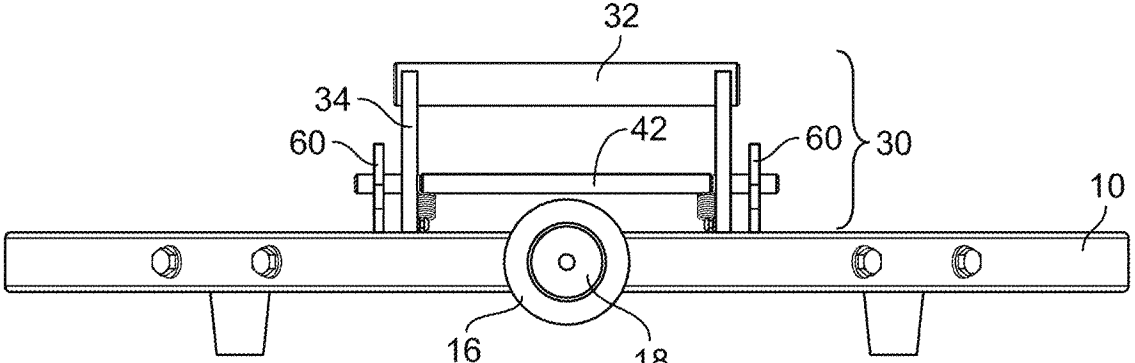
FIG. 9 illustrates an end-on view of the trap bar with adjustable handles.

Referring to FIG. 9, an end-on view of the trap bar with adjustable handles is shown.

The grip 32 and arms 34 of a handle assembly 30 are shown, with the locking member 42 interfacing with the fixed receiver 60.

A collar 16 and bar 18 are shown for the addition of weights.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A trap bar that allows a user to select a handle position that fits a user's size, the trap bar comprising:

a frame;

a first handle assembly and a second handle assembly;

the first handle assembly formed from a first grip connected to a first arm;

the first arm rotating with respect to the frame;

the second handle assembly formed from a second grip connected to a second arm;

the second arm rotating with respect to the frame;

the first grip always parallel to the second grip;

the first grip and second grip being horizontal when the trap bar is in use;

a first locking member that slides within a first channel, the first channel within the first arm;

the first locking member having a locked position and an unlocked position;

an elastic member biasing the locking member toward the locked position;

the user configured to move the first locking member between the locked position and the unlocked position by squeezing the first locking member toward the first grip;

whereby the user may unlock the locking member, move the first grip to the chosen location, and release the locking member to cause the grip to maintain position at the chosen location; and whereby a user moves each handle assembly to a chosen location depending on the user's size and preference.

2. The trap bar of claim 1, further comprising:

a first fixed sleeve;

a first rotating member partially enclosed by the first fixed sleeve;

the first arm affixed to the first rotating member;

whereby the first rotating member defines a first axis about which the first grip rotates;

a second fixed sleeve;

a second rotating member partially enclosed by the second fixed sleeve;

the second arm affixed to the second rotating member;

whereby the second rotating member defines a second axis about which the second grip rotates.

3. The trap bar of claim 1, further comprising:

a first fixed sleeve;

a first fixed receiver mounted to the first fixed sleeve, the fixed receiver including a slot and one or more tabs;

the first locking member interfacing with the slot of the first fixed receiver;

whereby when in the unlocked position the first locking member moves freely within the slot, and when in the locked position the first locking member is held in position by the one or more tabs.

4. The trap bar of claim 1, further comprising:

a first fixed sleeve;

a first fixed receiver mounted to the first fixed sleeve;

a first locking mechanism, wherein the first locking mechanism comprises the first locking member and the elastic member, connecting the first handle assembly and the first fixed receiver;

the first locking mechanism disengaging to permit movement of the first handle assembly with respect to the first fixed receiver;

the first locking mechanism engaging to prohibit movement of the first handle assembly with respect to the first fixed receiver.

5. The trap bar of claim 4, the first fixed receiver further comprising:

a receiver channel;

one or more tabs;

one or more notches adjacent each tab of the one or more tabs;

whereby when disengaged, the first locking mechanism moves freely within the receiver channel; and where by when engaged, the first locking mechanism is retained in a notch of the one or more notches.

6. The trap bar of claim 1, further comprising:

a bar upon which weights may be placed;

the bar held to the frame by two or more fasteners;

whereby the use of two or more fasteners prevents rotation of the bar with respect to the frame.

7. A device that permits a user to adjust a handle position of a trap bar, the device comprising:

a right adjustable grip;

the right adjustable grip movable along an arc between a first position and a second position;

the first position closer to a center of the device, the second position further from the center of the device;

the user able to select between the first position and the second position;

a left adjustable grip;

the left adjustable grip movable along an arc between a first position and a second position;

the first position closer to a center of the device, the second position further from the center of the device;

the user able to select between the first position and the second position;

the right grip and left grip remaining parallel in all positions;

a right fixed sleeve;

a right fixed receiver mounted to the right fixed sleeve, the fixed receiver including a slot and one or more tabs;

a right locking member interfacing with the slot of the right fixed receiver;

whereby when in an unlocked position the right locking member moves freely within the slot, and when in a locked position the right locking member is held in position by the one or more tabs; and whereby the user can adjust for size by choosing the positions of the right grip and left grip.

8. The device of claim 7, the right adjustable grip and left adjustable grip each further comprising:

a fixed sleeve;

a rotating member partially enclosed by the fixed sleeve;

an arm affixed to the rotating member;

whereby the rotating member defines an axis about which the respective grip rotates.

9. The device of claim 7, the right adjustable grip and left adjustable grip each further comprising:

the locking member that slides within a channel, the channel within an arm;

the locking member having the locked position and an unlocked position;

an elastic member biasing the locking member toward the locked position;

the user moving the locking member between the locked position and the unlocked position by squeezing the locking member toward the grip;

whereby the user may unlock the locking member, move the grip to the chosen location, and release the locking member to cause the grip to maintain position at the chosen location.

10. The device of claim 7, further comprising:

a bar upon which weights may be placed;

the bar held to the frame by two or more fasteners;

whereby the use of two or more fasteners prevents rotation of the bar with respect to the frame.

11. A device for performing deadlifts by a user, the device comprising:

a frame;

a pair of adjustable handles attached to the frame;

each adjustable handle of the pair of adjustable handles defining an axis;

the axes being separated by a distance;

the adjustable handles able to move toward and away from each other, decreasing and increasing the distance between the axes, with each adjustable handle rotating about a fixed point;

adjustment of the adjustable handles being constrained such that the axes remaining constantly parallel;

a pair of fixed sleeves;

a pair of fixed receivers, each mounted to its respective fixed sleeve of the pair of fixed sleeves;

a pair of locking mechanisms connecting each adjustable handle of the pair of adjustable handles to its respective fixed receiver of the pair of fixed receivers;

each locking mechanism disengaging to permit movement of the adjustable handle with respect to the fixed receiver;

each locking mechanism engaging to prohibit movement of the adjustable handle with respect to the fixed receiver.

12. The device of claim 11, each fixed receiver further comprising:

a channel;

one or more tabs;

one or more notches adjacent each tab of the one or more tabs;

whereby when disengaged, each locking mechanism moves freely within its channel; and where by when engaged, each locking mechanism is retained in a notch of the one or more notches.

13. The device of claim 11, further comprising:

a bar upon which weights may be placed;

the bar held to the frame by two or more fasteners;

whereby the use of two or more fasteners prevents rotation of the bar with respect to the frame.

* * * * *